US008237535B2

(12) United States Patent
Hollevoet et al.

(10) Patent No.: US 8,237,535 B2
(45) Date of Patent: Aug. 7, 2012

(54) INTEGRAL PLANAR TRANSFORMER AND BUSBAR

(75) Inventors: Koen Hollevoet, Merelbeke (BE); Sebastiaan De Boodt, Laame (BE)

(73) Assignee: World Properties, Inc., Lincolnwood, IL (US)

( * ) Notice: Subject to any disclaimer, the term of this patent is extended or adjusted under 35 U.S.C. 154(b) by 175 days.

(21) Appl. No.: 12/761,494

(22) Filed: Apr. 16, 2010

(65) Prior Publication Data

US 2011/0254649 A1 Oct. 20, 2011

(51) Int. Cl.
*H01F 5/00* (2006.01)

(52) U.S. Cl. ..... 336/200

(58) Field of Classification Search ..... 336/65, 336/83, 200, 206–208, 232, 192
See application file for complete search history.

(56) References Cited

U.S. PATENT DOCUMENTS

| | | | | |
|---|---|---|---|---|
| 3,258,727 | A | 6/1966 | Weinsheimer et al. | |
| 5,331,536 | A * | 7/1994 | Lane | 363/126 |
| 5,386,206 | A | 1/1995 | Iwatani et al. | |
| 5,781,093 | A | 7/1998 | Grandmont et al. | |
| 6,144,276 | A | 11/2000 | Booth | |
| 6,278,351 | B1 | 8/2001 | Wheatley | |
| 6,313,991 | B1 | 11/2001 | Nagashima et al. | |
| 6,356,182 | B1 * | 3/2002 | Nagashima | 336/200 |
| 6,461,172 | B2 | 10/2002 | Ross | |
| 7,123,123 | B2 | 10/2006 | Isurin et al. | |
| 7,207,187 | B2 | 4/2007 | Funahashi et al. | |
| 7,215,555 | B2 | 5/2007 | Takagi | |
| 7,318,269 | B2 * | 1/2008 | Yoshida et al. | 29/602.1 |
| 7,439,839 | B2 * | 10/2008 | Podlisk et al. | 336/200 |
| 7,514,829 | B2 | 4/2009 | Otsuji et al. | |
| 7,518,851 | B2 | 4/2009 | Tsuchiya et al. | |
| 2002/0002771 | A1 | 1/2002 | Lin et al. | |
| 2002/0044331 | A1 | 4/2002 | Agrawal et al. | |

(Continued)

FOREIGN PATENT DOCUMENTS

CN 101335442 A 12/2008

(Continued)

OTHER PUBLICATIONS

International Search Report mailed Sep. 6, 2011 for International Application No. PCT/US2011/030426 filed Mar. 30, 2011.

(Continued)

*Primary Examiner* — Tuyen Nguyen
(74) *Attorney, Agent, or Firm* — Cantor Colburn LLP

(57) ABSTRACT

The primary and/or secondary coils of a relatively high power planar transformer are integrated together with a laminated busbar, thereby incorporating together the planar transformer and the busbar as a single component. A coil is cut out or otherwise formed in at least one busbar conductor, and when electrically connected, the busbar coils act as part of the primary and/or secondary circuit of the transformer. One or more coil lead frames are embedded in the laminated stack, and when electrically connected, form the primary and/or secondary circuit, respectively, of the transformer. Insulating material coils are also embedded within the laminated stack. The center leg of an E-shaped ferrite core passes through the center opening of each of the busbar coils, the coil lead frames, and the insulating material coils. The E-shaped core is located next to (i.e., with an opening) or closed with, an I-shaped or E-shaped core.

20 Claims, 2 Drawing Sheets

U.S. PATENT DOCUMENTS

| | | | | |
|---|---|---|---|---|
| 2003/0052767 | A1* | 3/2003 | Yamanobe et al. | 336/232 |
| 2007/0188282 | A1 | 8/2007 | Folts et al. | |
| 2008/0100993 | A1 | 5/2008 | Muller et al. | |
| 2009/0121704 | A1 | 5/2009 | Shibahara | |
| 2009/0161301 | A1 | 6/2009 | Woody et al. | |
| 2009/0243782 | A1 | 10/2009 | Fouquet et al. | |

FOREIGN PATENT DOCUMENTS

| | | | |
|---|---|---|---|
| EP | 0919438 | A2 | 6/1999 |
| EP | 1577977 | A1 | 9/2005 |
| FR | 2476898 | | 8/1981 |
| GB | 418933 | | 11/1934 |
| JP | 2000215735 | A | 8/2000 |
| JP | 2000350335 | A | 12/2000 |
| JP | 2003219545 | A | 7/2003 |
| JP | 2005036773 | | 2/2005 |
| JP | 2007028896 | | 2/2007 |
| JP | 2007294896 | A | 11/2007 |
| JP | 2008287890 | | 11/2008 |
| JP | 2008295227 | | 12/2008 |
| JP | 2009011039 | | 1/2009 |
| WO | 0195435 | A2 | 12/2001 |
| WO | 2008146770 | A1 | 12/2008 |

OTHER PUBLICATIONS

Written Opinion of the International Searching Authority mailed Sep. 6, 2011 for International Application No. PCT/US2011/030426 filed Mar. 30, 2011.

Himag Solutions Product Range [online], Retrieved on Mar. 22, 2010; Retrieved from http://www.himag.co.uk/page.asp?id=9.

Douglas C. Hopkins, Ph.D.; Laminated Bus Bar; Copyright 2006, D.C. Hopkins; 12 Pages.

Zero Voltage Transition Full Bridge Planar Transformer [online]; Retrieved on Mar. 22, 2010; Retrieved from http://www.electronicspecifier.com/Power/New-Zero-Voltage-Transition-Full-Bridge-Planar-Transformer.asp.

* cited by examiner

INTEGRAL PLANAR TRANSFORMER AND BUSBAR

BACKGROUND OF THE INVENTION

The subject matter disclosed herein relates to planar transformers and busbars and, more particularly, to a planar transformer and busbar integrated together as a single component for use, for example, in relatively high power electrical distribution and power conversion device applications.

A planar transformer and a planar inductor each typically comprises a plurality of parallel and/or interleaved copper conductors, separated by insulation layers, arranged in a stack and surrounded by a core. The planar transformer has oftentimes two separate strings of one or more serial connected coils, one string being the primary circuit and the other string being the secondary circuit, with the coils of each circuit commonly being interleaved with one another. Insulation layers may be interleaved with each coil of the primary circuit and the secondary circuit. A planar inductor has oftentimes only one string of one or more serial connected coils. These devices are used in applications such as relatively low power DC-DC converters and power conversion devices, and to a lesser extent in high power applications. Planar transformers and inductors are relatively compact in size compared to the common wound versions, and these planar devices may be designed with relatively higher efficiency and increased thermal management.

Planar transformers can be made with traditional laminated printed circuit board ("PCB") technology, and may even be embedded within the PCB itself. However, in the power range of 1.5 kW or greater, or when electrical currents exceed 100 A, the ability to use traditional PCB technology for planar transformers is at its limits or is exceeded. Relatively high currents require relatively thick copper conductors (e.g., 0.2 mm up to 0.8 mm or greater), which is beyond the capability of typical PCB manufacturing processes. One of the problematic PCB manufacturing processes is the etching process, in which the edges of the circuit become increasingly less defined (i.e., "fuzzy") with increasing copper thickness. Also, processing time increases significantly with increasing thickness of the copper layer. An alternative process, such as electrolytic copper plating to increase the copper thickness, is relatively expensive and the planarity of the conductor surface becomes more problematic as the thickness increases.

On the other hand, laminated busbars are suitable for circuits that conduct high frequency alternating currents. A busbar typically comprises a stack of a plurality of parallel and/or interleaved copper conductors, separated by insulation layers. The relatively high currents utilized in busbars require conductors with a relatively thick copper gauge to reduce resistance and excessive heating. Instead of chemical etching, the preferred methods to form the conductor paths are mechanical processes such as, for example, punching, water jetting, laser cutting, milling, and others.

The busbar circuit may have flat conductors that are positioned parallel to each other, with a relatively small distance in between different layers and the conductor layers are separated by layers of insulating material to form a stack. The insulation material, with or without an adhesive coating applied in advance or during the process, is typically positioned between the conductors and all the layers in the stack are pressed together in a lamination process using heat and pressure, resulting in a solid busbar circuit. Due to the relatively good thermal conductivity of copper, the busbar also has a relatively good thermal spreading capability. The exposed surface of the busbar also makes it relatively easy to cool.

Relatively high power DC-DC converters are finding increased use where power storage devices (e.g., batteries, super capacitors, etc.) are used. Other typical high power DC-DC converter applications include hybrid electrical vehicles, military, avionics, windmill pitch control and emerging applications related to renewable energy sources that produce DC voltage (e.g., solar).

It is known that when a busbar is used in a relatively high-power DC-DC converter (typical greater than 1.5 kW), the planar transformer, and most often the inductor, are separate components. The planar transformer, busbar and inductor are typically within the AC portion of the DC-DC converter. Other applications can be in the rectifier. The secondary circuit of the transformer is typically mounted to the busbar by means of screws and bolts, and drums if needed, or by soldering or other connection methods. The typically single interconnection location between the planar transformer and the busbar can be ground for additional connection losses, thereby creating an undesirable hot spot or local heating at that single connection location due to all of the electrical current being concentrated to one side at the single connection location.

As the power density increases, the temperature in the planar transformer tends to increase, as a result of which passive or active cooling may be required. Conductive, convection, or liquid cooling of the planar device is typically carried out through the ferrite core (or other suitable core material), in which the core is connected to a cooling plate, heat spreader or other cooling device or system.

What is needed is a planar transformer and a busbar integrated together to form a single integral component for use in relatively high power electrical distribution and conversion device applications, wherein integrating the planar transformer with the busbar creates a relatively more balanced connection between the transformer and the busbar, thereby improving the flow of current between the transformer and the busbar and reducing interconnection losses and electrical current hotspots.

BRIEF DESCRIPTION OF THE INVENTION

According to embodiments of one aspect of the present invention, one or both of the primary and secondary coils of a relatively high power planar transformer are integrated together with a laminated busbar, thereby incorporating together the planar transformer and the busbar as a single integral component. A coil is cut out or otherwise formed in at least one of the busbar conductors, and when electrically connected, the busbar coils act as part of the primary and/or secondary circuit of the planar transformer. One or more coil lead frames are embedded in the laminated transformer/busbar stack, and when electrically connected, form the primary circuit and/or the secondary circuit, respectively, of the planar transformer. Insulating material coils are also embedded within the laminated transformer/busbar stack. The center leg of an E-shaped ferrite core passes through the center opening of each of the busbar coils, the coil lead frames, and the insulating material coils. The E-shaped core is located next to (i.e., with an opening) or closed with, an I-shaped or E-shaped core.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
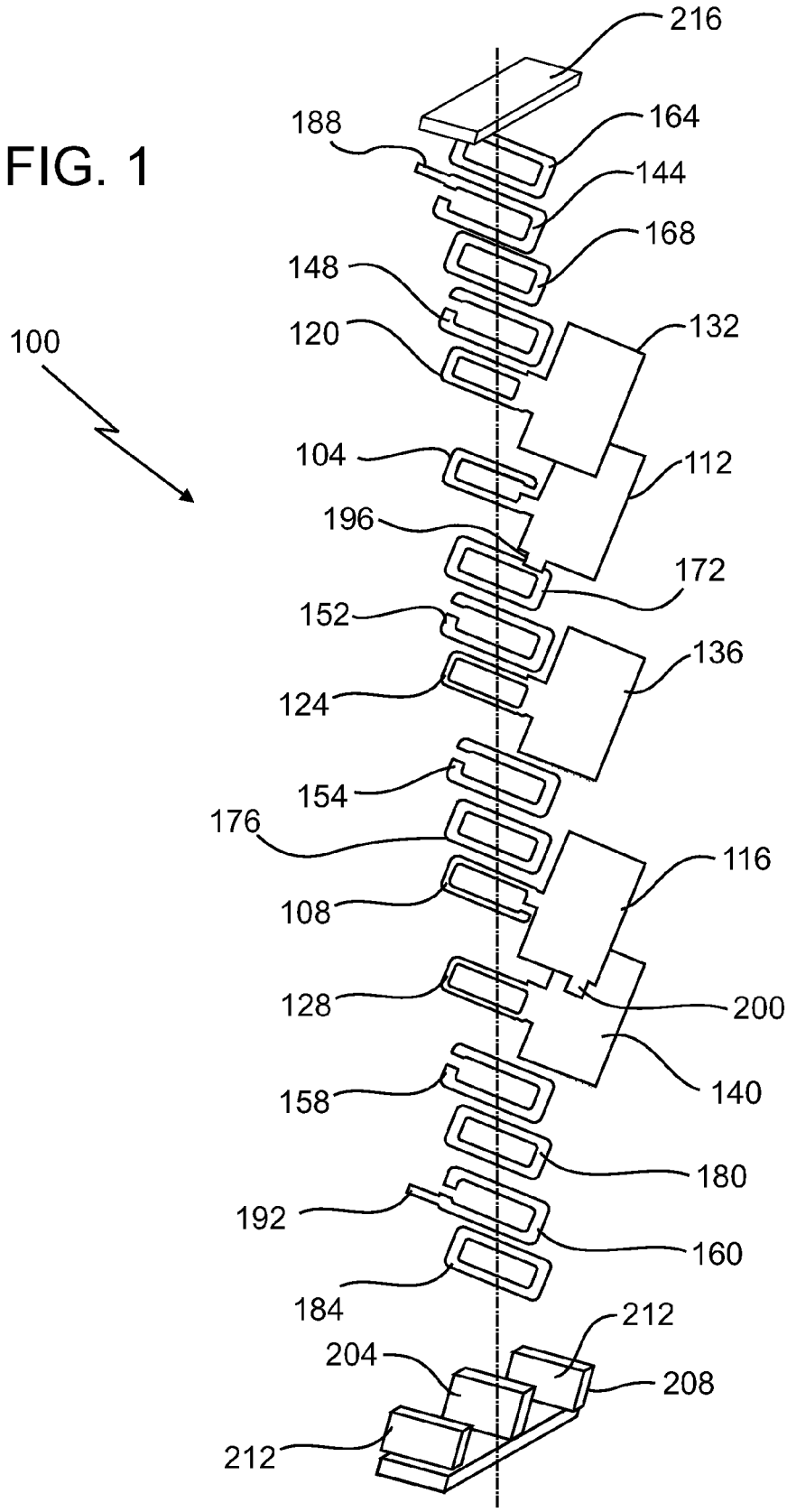
FIG. 1 is an exploded view of portions of a planar transformer integrated with portions of a busbar to form a single integral component in accordance with embodiments of the present invention.

Referring to FIG. 1 there illustrated in exploded form are the portions of a planar transformer integrated together with the portions of a busbar to form a single uniform component 100 in accordance with embodiments of the present invention. The resulting integrated planar transformer and busbar component 100 may be part of a power distribution or power conversion device, such as a DC-DC converter, or other type of device that utilizes a planar transformer and a busbar in relatively high power (>1.5 kW) and/or high current (>100 A) applications.

In a typical transformer, two coiled circuits are required, a primary and a secondary circuit. Each circuit typically comprises a string of serial connected coils. A core, typically magnetic, is also provided around which the coiled circuits are located. Embodiments of the present invention include at least one of the primary and/or secondary coiled circuits being an integral part of the busbar circuit. In the embodiment of the integrated component 100 shown in FIGS. 1 and 2, only the secondary circuit is formed as part of the busbar circuit. However, it should be understood that based on the teachings herein, both the primary and the secondary circuits of the planar transformer may be formed as part of the busbar circuit when forming the integrated component 100, in accordance with further embodiments of the present invention. In addition, in other embodiments of the present invention, the secondary circuit of a planar transformer formed as part of the busbar circuit, as described and illustrated herein in detail, may instead comprise an inductor; i.e., a single coil device.

In FIG. 1, the busbar coils 104, 108 that comprise the transformer secondary circuit may be mechanically formed integrally as contiguous with or connected to the corresponding busbar conductors 112, 116. FIG. 1 shows two secondary busbar coils 104, 108 and corresponding busbar conductors 112, 116, although any number of transformer secondary coils 104, 108 and corresponding busbar conductors 112, 116 may be utilized. The coils 104, 108 and the busbar conductors 112, 116 may be planar in shape and may comprise copper or other suitable conductive material. The resulting center opening shape of the coils 104, 108 may each be formed by, e.g., cutting of the corresponding busbar conductors 112, 116 or by other suitable methods. Also, each busbar coil 104, 108 may not be a contiguous coil and may, instead, have an opening or an end point that is not connected with the remainder of the coil 104, 108 or the corresponding busbar conductor 112, 116. In addition, the busbar coils 104, 108 may be in a string that comprises a serial connection of the coils 104, 108. The coils 104, 108 and busbar conductors 112, 116 may each be made as one piece of copper, or as separate parts connected through, for example, soldering, welding, brazing, etc., as is known in the art. Further, each of the coils 104, 108 may comprise at least one winding and, thus, in some embodiments, each coil 104, 108 may comprise multiple windings.

The coils 104, 108 and the busbar conductors 112, 116 are electrically insulated from one another (and from the primary circuit coils) by a coil insulator 120, 124, 128 integrated together with a corresponding busbar insulator 132, 136, 140. The insulators 120-140 may comprise any suitable insulating material, with or without an adhesive coating. Typically the busbar coils 104, 108 and the busbar conductors 112, 116 may be insulated with the insulators 120-140 that may comprise UL-94 V-0 flame retardant dielectric films such as polyethylene terephtalate, polyethylene naphthalate, and polyvinylfluoride. In applications requiring high temperature resistance, polyimides, polyetheretherketones, polyaryletherketones, and polypheneylenesulfides may be used. The dielectric films may be coated on one or both sides with adhesives that may include epoxy, acrylate, or polyurethane modified resin systems. The use of the insulators 120-140 does not disturb the serial string connection of the busbar coils 104, 108 and the corresponding busbar conductors 112, 116.

The primary circuit of the planar transformer may be formed by interconnecting a plurality of electrically conductive lead frame coils 144-160 and interleaving these coils 144-160 with the coils 104-128 of the secondary circuit and with the insulation layers 120-128, 164-184. Each of the lead frame coils 144-160 may comprise at least one winding and, in some embodiments, each lead frame coil 144-160 may comprise multiple windings.

Figure 2:
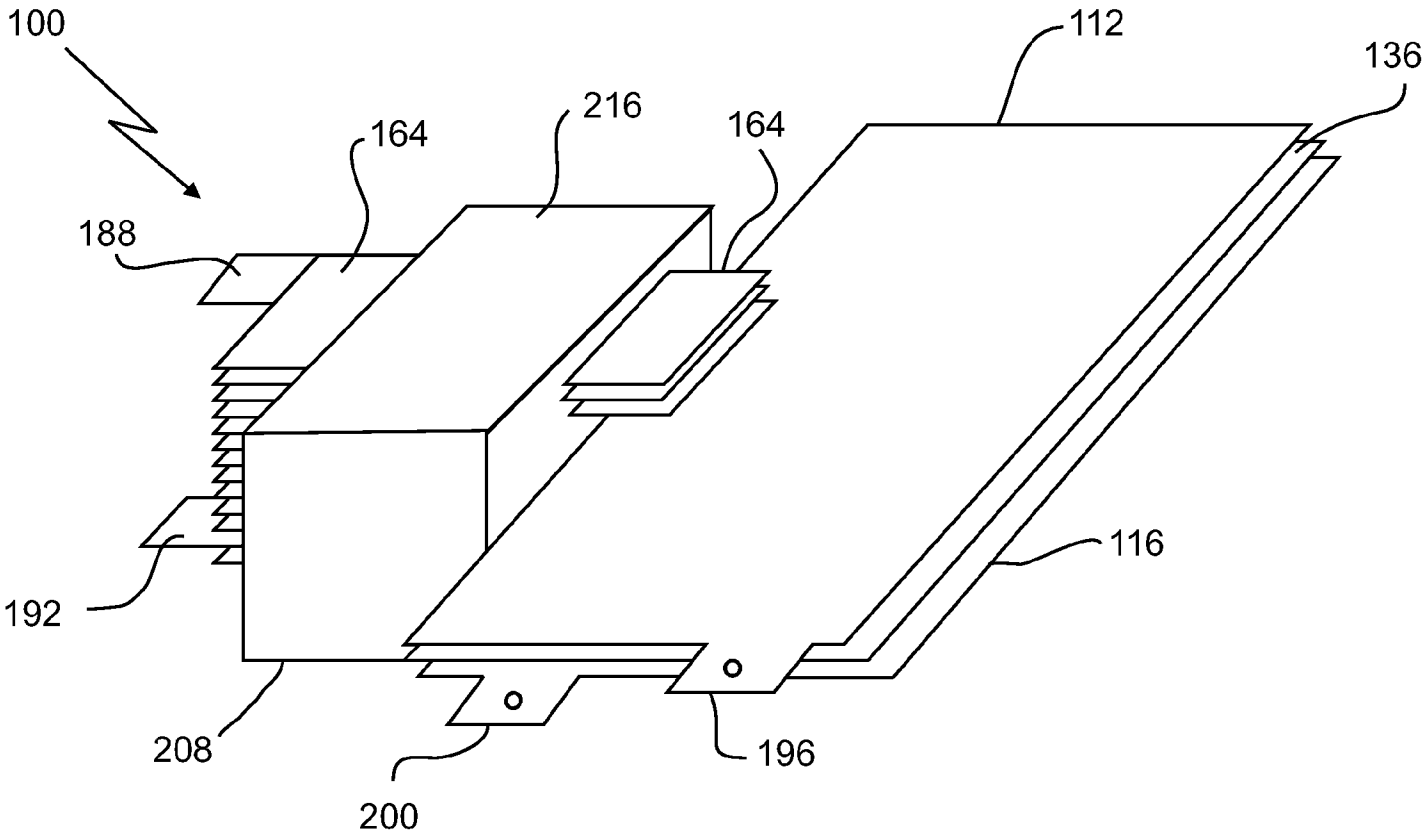
FIG. 2 is an isometric view of the planar transformer integrated with the busbar according to the embodiment of FIG. 1 in assembled form.

Referring also to FIG. 2, an extension tab 188, 192 is provided on two of the lead frame coils 144, 160 in the primary circuit of the planar transformer. The tabs 188, 192 facilitate the connection to the primary circuit of the planar transformer by other circuit components (not shown), thereby also electrically connecting together the primary circuit. The busbar conductors 112, 116 can also each include an extension tab 196, 200 to facilitate connection to the secondary circuit of the planar transformer by other circuit components (not shown), thereby also electrically connecting together the secondary circuit. In the alternative, the connections can be made directly to each of the busbar conductors 112, 116 without utilizing any tabs 196, 200.

The stack of conductor and insulation layers may be laminated together by exposing the stack to temperature and pressure, thereby turning the stack into a solid construction or assembly, as illustrated in FIG. 2. This solid construction assembly forms the integrated planar transformer and busbar component 100 according to embodiments of the present invention. In the center of each of the coils and insulation layers, a hole is provided to allow the center leg 204 of an E-shaped core 208 to pass through the stack. The width of the conductor layer tracks and of the insulation layer tracks in the respective coil portions thereof is determined by electrical design requirements and by the available space between the outer legs 212 and the center leg 204 of the E-shaped core 208. An I-shaped core 216 or a second E-shaped core 216 may be mounted on top of the first E-shaped core 208. The E-shaped core 208 and the I-shaped core 216 are typically made of ferrite material, but can also be made out of other suitable core materials typically used in planar magnetics. To conform to the art of designing transformers and inductors, an airgap may be provided between the cores 208, 216. For reasons of coupling and reducing electromagnetic field or others, multiple parallel layers of busbar conductors 112, 116 can be interleaved with busbar conductors of the opposite polarity.

Various topologies and configurations are possible for the planar transformer or inductor, as well as for the busbar; for example, a greater number of coil frames can be connected in series to the busbar coils to increase the number of windings, or a greater number of coiled busbar layers can be added in case of bifilar designs or to create multiple transformer outputs.

The integrated planar transformer and busbar component 100 according to embodiments of the present invention enables a relatively more compact construction of a power device, e.g., a DC-DC converter. The number of components and connections in the resulting assembly of the component 100 is reduced as compared to known designs. The thermal management of the component 100 is improved because the busbar is now directly part of the transformer function. The heat that is generated internally in the transformer can be evacuated relatively quickly through the busbar instead of through the ferrite (or other suitable material) transformer core. The hot spots related to connection losses between the planar transformer and the busbar can be eliminated.

Different constructions and conductor combinations are possible, depending on the type, design and characteristics of the device (e.g., DC-DC converter) in which the component 100 is utilized, and enables further reduction of connection losses and proximity losses. Embodiments of the present invention may be applicable as well to inductors instead of transformers; that is, components with only a single coiled circuit.

Embodiments of the present invention provide for the elimination of interconnection losses on the busbar side of the connection point between the planar transformer and the busbar. They also provide for relatively improved cooling such that more heat can dissipate through the busbar side without creating additional heating related to interconnection losses (i.e., some connections are eliminated). Further, embodiments of the present invention provide for a relatively more compact design and construction, while also making it possible to eliminate impregnation process (i.e., reducing technical and health and safety risks). Also, a reduction in the parts count may be achieved due to the fact that the planar transformer is now part of the busbar circuit. Other features include a reduction of electromagnetic field and proximity losses, and improved vibration and shock resistance due to the single, solid low-profile construction and reduced parts count. Further, improved diode commutation due to lower stray inductance of the output windings may be achieved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. Apparatus, comprising:

a planar transformer having at least one primary circuit comprised of one or more serial connected conductive coils and a secondary circuit comprised of one or more serial connected conductive coils, the planar transformer configured such that when a first voltage is applied across the primary circuit a second voltage is produced across the secondary circuit;

a busbar having at least two layers of conductive material, wherein at least one of the one or more coils of the primary or secondary circuit of the planar transformer is integral with at least one of the at least two layers of conductive material of the busbar; and a core.

2. The apparatus of claim 1, wherein at least one of the one or more coils of the primary circuit or secondary circuit is one of contiguous with or connected with the corresponding one of the at least two layers of conductive material of the busbar.

3. The apparatus of claim 1, wherein the one or more coils of the primary circuit or secondary circuit comprises one or more coils of the secondary circuit, wherein the primary circuit comprises one or more coils of conductive material, and wherein a layer of insulating material is disposed between each one of the one or more coils of the secondary circuit and/or the one or more coils of the primary circuit and between the at least two layers of conductive material of the busbar.

4. The apparatus of claim 3, wherein the layer of insulating material comprises a coil with an opening.

5. The apparatus of claim 4, wherein the layer of insulating material comprises a flame retardant dielectric film from the group that comprises polyethylene terephtalate, polyethylene naphthalate, polyvinylfluoride, a polyimide, a polyetheretherketone, and a polypheneylenesulfide, and wherein the layer of insulating materials is coated on at least one side with an adhesive from the group that comprises an epoxy, an acrylate, or a polyurethane modified resin.

6. The apparatus of claim 4, wherein the core comprises a portion located through an opening in the one or more coils of the secondary circuit, through an opening in the one or more coils of the primary circuit, and through the opening in the coil of each one of the layers of insulating material.

7. The apparatus of claim 6, wherein the core comprises a first E-shaped core in which the portion of the core located through an opening in each one of the one or more coils of the secondary circuit, through an opening in each one of the one or more coils of the primary circuit, and through the opening in the coil of each one of the layers of insulating material comprises a center leg portion of the E-shaped core, and further comprising one of a second E-shaped core or an I-shaped core co-located with the first E-shaped core such that one of an opening is located between the first E-shaped core and the one of a second E-shaped core or an I-shaped core or that the first E-shaped core and the one of a second E-shaped core or an I-shaped core are disposed in an abutting relationship to one another.

8. The apparatus of claim 1, wherein the one or more coils of the primary circuit or secondary circuit comprises a plurality of coils of the secondary circuit, wherein the primary circuit comprises a plurality of coils of conductive material interleaved in an arrangement with the plurality of coils of the secondary circuit, and wherein layers of the insulating material are each disposed between the coils of the primary circuit and the secondary circuit in the interleaved arrangement or between the coils of the primary circuit in the interleaved arrangement or between the coils of the secondary circuit in the interleaved arrangement, wherein the interleaved arrangement is laminated.

9. Apparatus, comprising:

at least one coil having at least one winding;

a busbar having at least two layers of conductive material, wherein at least one of the at least one coil having at least one winding is integral with at least one of the at least two layers of conductive material of the busbar; and a core having at least one leg;

wherein the at least one coil provides a current path that completely surrounds the at least one leg.

10. The apparatus of claim 9, wherein at least one of the at least one coil is one of being contiguous with or connected with the at least one layer of conductive material of the busbar.

11. The apparatus of claim 9, wherein the at least one coil comprises a plurality of serial connected coils, wherein a layer of insulating material is disposed between pairs of the plurality of coils, wherein the layer of insulating material comprises a flame retardant dielectric film from the group that comprises polyethylene terephtalate, polyethylene naphthalate, polyvinylfluoride, a polyimide, a polyetheretherketone, and a polypheneylenesulfide, and wherein the layer of insulating materials is coated on at least one side with an adhesive from the group that comprises an epoxy, an acrylate, or a polyurethane modified resin.

12. The apparatus of claim 9, wherein the at least one coil comprises one of a primary circuit or a secondary circuit of a planar transformer.

13. The apparatus of claim 12, wherein the at least one coil comprises a plurality of serial connected coils of a secondary circuit of the planar transformer, wherein the primary circuit of the planar transformer comprises a plurality of serial connected coils of conductive material interleaved in an arrangement with the plurality of coils of the secondary circuit, wherein layers of the insulating material are each disposed between the coils of the primary circuit and the secondary circuit in the interleaved arrangement or between the coils of the primary circuit in the interleaved arrangement or between the coils of the secondary circuit in the interleaved arrangement, wherein the interleaved arrangement is laminated.

14. The apparatus of claim 13, wherein the core comprises a first E-shaped core in which the portion of the core located through an opening in each of the plurality of coils of the secondary circuit, through an opening in each of the plurality of coils of the primary circuit, and through an opening in each of the coils of layers of insulating material comprises a center leg portion of the E-shaped core, and further comprising one of an second E-shaped core or an I-shaped core co-located with the first E-shaped core such that one of an opening is located between the first E-shaped core and the one of a second E-shaped core or an I-shaped core or that the first E-shaped core and the one of a second E-shaped core or an I-shaped core are disposed in an abutting relationship to one another.

15. A component, comprising:

a planar transformer having a primary circuit comprised of a plurality of serial connected coils and a secondary circuit comprised of a plurality of serial connected coils, wherein each of the plurality of coils of the primary circuit and the secondary circuit has at least one winding, the planar transformer configured such that when a first voltage is applied across the primary circuit a second voltage is produced across the secondary circuit;

a busbar having a plurality of layers of conductive material, wherein at least one of the plurality of coils of one of the primary circuit or secondary circuit of the planar transformer is integral with at least one of the plurality of layers of conductive material of the busbar; and a core.

16. The component of claim 15, wherein a layer of insulating material is disposed between pairs of the plurality of coils and between pairs of the plurality of layers of the conductive material of the busbar, wherein the layer of insulating material comprises a flame retardant dielectric film from the group that comprises polyethylene terephtalate, polyethylene naphthalate, polyvinylfluoride, a polyimide, a polyetheretherketone, and a polypheneylenesulfide, and wherein the layer of insulating materials is coated on at least one side with an adhesive from the group that comprises an epoxy, an acrylate, or a polyurethane modified resin.

17. The component of claim 15, wherein the plurality of coils of the primary circuit are interleaved in an arrangement with the plurality of coils of the secondary circuit, and wherein layers of insulating material are each disposed between the coils of the primary circuit and the secondary circuit in the interleaved arrangement or between the coils of the primary circuit in the interleaved arrangement or between the coils of the secondary circuit in the interleaved arrangement, wherein the interleaved arrangement is laminated.

18. The component of claim 17, wherein the core comprises a first E-shaped core in which a portion of the core is located through an opening in each of the plurality of coils of the secondary circuit, through an opening in each of the plurality of coils of the primary circuit, and through an opening in coils of the layers of insulating material comprises a center leg portion of the E-shaped core, and further comprising one of an second E-shaped core or an I-shaped core co-located with the first E-shaped core such that one of an opening is located between the first E-shaped core and the one of a second E-shaped core or an I-shaped core or that the first E-shaped core and the one of a second E-shaped core or an I-shaped core are disposed in an abutting relationship to one another.

19. The component of claim 15, wherein one or more of the plurality of coils of the secondary circuit is contiguous with the corresponding one of the layers of conductive material of the busbar.

20. The component of claim 15, wherein one or more coils of the secondary circuit is connected with the corresponding one of the layers of conductive material of the busbar.

* * * * *